US006927731B2

(12) United States Patent
Leclerc et al.

(10) Patent No.: US 6,927,731 B2
(45) Date of Patent: Aug. 9, 2005

(54) ANTENNA OF SMALL VOLUME FOR A PORTABLE RADIO APPLIANCE

(75) Inventors: Daniel Leclerc, Crissey (FR); Ayoub Annabi, Dole (FR); Roland Vincent, Dole (FR)

(73) Assignee: Amphenol Socapex (FR)

( * ) Notice: Subject to any disclaimer, the term of this patent is extended or adjusted under 35 U.S.C. 154(b) by 0 days.

(21) Appl. No.: 10/434,124

(22) Filed: May 9, 2003

(65) Prior Publication Data

US 2004/0119651 A1 Jun. 24, 2004

(30) Foreign Application Priority Data

Dec. 23, 2002 (FR) ..... 02 16516

(51) Int. Cl.[7] ..... H01Q 1/24
(52) U.S. Cl. ..... 343/702; 343/789
(58) Field of Search ..... 343/700 MS, 702, 343/789

(56) References Cited

U.S. PATENT DOCUMENTS 5,781,159 A * 7/1998 Desargant ..... 343/700 MS
5,861,854 A * 1/1999 Kawahata et al. ..... 343/702
5,867,131 A * 2/1999 Camp et al. ..... 343/797
6,259,407 B1 7/2001 Tran ..... 343/700 MS

FOREIGN PATENT DOCUMENTS

| | | |
|---|---|---|
| WO | WO 01/26181 | 4/2001 |
| WO | WO 01/28038 | 4/2001 |
| WO | WO/02/27865 | 4/2002 |

* cited by examiner

*Primary Examiner*—Michael C. Wimer
(74) *Attorney, Agent, or Firm*—Blank Rome LLP

(57) ABSTRACT

The present invention provides a very small volume and broad band antenna for a portable appliance including a transceiver module with an independent ground and an antenna feed conductor, the antenna comprising a first conductive surface lying substantially in a first geometrical surface of non-closed curvilinear shape surrounding an inside space and connectable to the independent ground of the transceiver module of the appliance; and a second conductive surface disposed substantially in a second geometrical surface substantially coinciding with the first geometrical surface and situated in the inside space, and forming a radiating assembly connectable to the antenna feed conductor; whereby the antenna is semi-independent of the elements of the appliance.

19 Claims, 5 Drawing Sheets

ANTENNA OF SMALL VOLUME FOR A PORTABLE RADIO APPLIANCE

The present invention relates to an antenna of small volume for use particularly but not exclusively in a mobile radiotelephone.

BACKGROUND OF THE INVENTION

In mobile radiotelephones, it is known to make use of helically-shaped antennas that are usually mounted on the outside of the radiotelephone case. Such antennas can be of relatively small size, but they are placed outside the case in order to be associated with a ground plane which is itself placed inside the case of the radiotelephone.

The present trend in making radiotelephones is to eliminate any external antenna so that the antenna is located inside the case. The trend is also to reducing the size of the radiotelephone, or at least to integrating a larger number of components in a radiotelephone of given outside dimensions.

As a result it is advantageous in designing a radiotelephone to have available an internal antenna of dimensions that are relatively small.

In order to satisfy the first condition, proposals have been made to use patch type antennas in radiotelephones of the PiFa type or similar. Such patch antennas are essentially constituted by a ground plane and by a radiating plate, generally a radiating element that is substantially parallel to the ground plane, and also including a short circuit connection between the radiating element and the ground plane together with an antenna feed that is generally a 50 ohm (Ω) feed although that is not essential, and generally made in the form of a microstrip line, or in the form of coaxial connectors, or in the form of parallel-contact connectors having a characteristic impedance close 50Ω.

In the frequency band used for radiotelephones, and in particular in the frequency band corresponding to the general system for mobile communications (GSM), where the center frequency is about 920 megahertz (MHz), the minimum distance between the radiating element and the ground plane is about 7 millimeters (mm) to 10 mm, at least when the dielectric between the radiating element and the ground plane is air. This thickness of the order of 7 mm to 10 mm is considered as being too great for making radiotelephones. Unfortunately, it is found that if attempts are made to reduce the thickness of a PiFa antenna, e.g. in order to bring it down to less than 5 mm, then the passband of the antenna is considerably reduced, thereby making it practically unusable. Known patch antennas thus do not satisfy the second above-specified condition any better.

OBJECTS AND SUMMARY OF THE INVENTION

An object of the present invention is to provide an antenna that is suitable for use in particular in a mobile radiotelephone and which presents very small volume, being of small thickness.

The antenna should also preferably be of an architecture that enables it to be used in at least two frequency bands.

To achieve this object, the invention provides a very small volume antenna for a portable appliance including a transceiver module with an independent ground and an antenna feed conductor, the antenna comprising:

a first conductive surface lying substantially in a first geometrical surface of non-closed curvilinear shape surrounding an inside space and connectable to the independent ground of the transceiver module of said appliance; and a second conductive surface disposed substantially in a second geometrical surface substantially coinciding with said first geometrical surface and situated in said inside space, and forming a radiating assembly connectable to the antenna feed conductor;

whereby said antenna is semi-independent of the elements of said appliance.

It will be understood that since the antenna is constituted by two conductive surfaces that are disposed in substantially the same geometrical surface as mentioned above, the thickness of the antenna can be very small, being either the thickness of the metal sheet from which its own surfaces are cut out, or else the thickness of the flexible or non-flexible insulating substrate on which metallization has been implemented. It is the connecting system that increases the thickness of the antenna in a localized position.

In addition, it will be understood that the second metallization which constitutes the radiating assembly of the antenna can be given a shape enabling the antenna to operate both in the GSM 850 (USA), GMS 900 (Europe) bands and in the DCS 1800 (Europe), PCS 1900 (USA) bands.

As explained below in greater detail, this antenna presents a very broad band, for example of the order of 25%, and it is characterized by semi-independence from the elements and the components of the radiotelephone appliance. The term "semi-independence" is used to mean that operation of the antenna is not affected by the other components or elements of the appliance in which the antenna is mounted. The antenna is disturbed only by the presence in its immediate vicinity of a mass or a source of radiation, for example a battery. It should also be observed that the ground of the antenna needs to be powered directly from the transceiver module of ground independent from the ground of the appliance.

The antenna is preferably mounted inside the appliance to which it is fitted. Nevertheless, given its shape which is deposited substantially on a single geometrical surface, it can be advantageous to deposit it in the external mechanical member that constitutes an attachment clip for the appliance, particularly if the appliance is a radiotelephone.

It would also be understood that the invention makes it possible to manufacture the antenna by implementing metallization of appropriate shapes on a flexible insulating support which is initially plane. Thereafter, the antenna can be fixed to a mechanical part or component which is not itself plane, the flexible insulating support taking up the particular shape of the mechanical part or component, with the antenna then having the shape of a curved geometrical surface.

In addition, various antenna feed solutions can be envisaged:

a) asymmetrical coaxial connection (connectors, cables);

b) symmetrical parallel lines (connectors).

Because the radiating elements and the conductive plate lie in the same plane, it is easy to integrate active or passive electronic components for adjusting frequency.

BRIEF DESCRIPTION OF THE DRAWINGS

Other characteristics and advantages of the invention appear better on reading the following description of various embodiments of the invention given as non-limiting examples. The description refers to the accompanying figures, in which.

MORE DETAILED DESCRIPTION

Figure 1A:
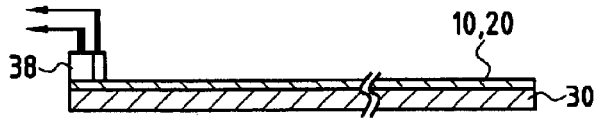
FIG. 1A is a plan view of an embodiment of the antenna.
Figure 1B:
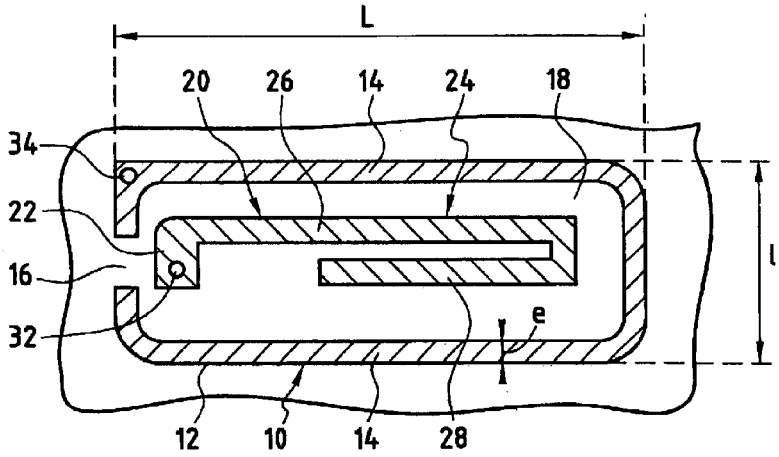
FIG. 1B is a vertical section view through the FIG. 1A antenna on line B—B.

Referring initially to FIGS. 1A and 1B, there follows a description of a first embodiment of an antenna of the invention. The antenna is constituted by a first conductive surface 10 that is substantially plane, being constituted by a conductive strip 12 whose midline 14 is substantially in the form of a rectangle with the exception of an opening 16, and whose width e is substantially constant. The length of the rectangle is written L and its width is written l. The conductive strip 12 defines an internal space 18.

Inside the internal space 18, the antenna comprises a second conducive surface 20 that is substantially plane and disposed in substantially the same plane as the first conductive surface 10.

The conductive surface 20 is constituted by a connection portion 22 and by a portion forming the radiating element 24 of the antenna. In this embodiment, the radiating element 24 is constituted by a first branch 26 connected to the connection zone 22, and by a shorter, second branch 28.

The term "substantially plane" is used to mean that the conductive surfaces are plane, ignoring departures from true planeness associated with the technology used for making them. The term "the two conductive surfaces are disposed in substantially the same plane" means likewise that the planes of these two conductive surfaces coincide, ignoring imperfections in the technology used to make them.

In this embodiment, the conductive surfaces 10 and 20 are constituted by respective areas of metallization made on an insulating support 30. The insulating support 30 may be of any appropriate kind, for example it can be made of epoxy, or it may be of the type comprising a flexible insulating substrate.

As mentioned above, when the insulating support is flexible, the antenna made thereon can subsequently be fixed to a support that is not itself plane, with the flexible support taking up the shape thereof.

That is why, in its broadest definition, the antenna is constituted by two conductive surfaces which are disposed in substantially the same geometrical surface, which surface may itself be curved.

The connection zone 22 of the second conductive surface 20 defines a connection point 32 for the antenna conductive, and the first conductive surface 10 includes additional metallization 34 constituting a ground connection suitable for connection to the transceiver module, which module has an independent ground.

The antenna may also include a connector 38 for connecting the radiating element 24 to the antenna conductor and for connecting the ground point 34 to the independent ground transceiver module of the appliance in which the antenna is incorporated. The connector 38 may be a coaxial connector. It is necessary that for the connection points 32 and 34 to be placed in such a manner as to present an impedance that is generally close to 50Ω in order to be connected to the central conductor and to the outer conductor of the coaxial cable 38. The connector may also be a two-channel connector having two parallel contacts, with the distance between the two contacts being selected appropriately so as to have a characteristic input impedance that is generally close to 50Ω.

As explained in greater detail below with reference to FIG. 4, the antenna made in this way presents a volume that is very small. Its length L and its width l can respectively be about 28 mm to 33 mm, and about 7 mm to 13 mm. Its thickness is that of the insulating substrate 30 which may be about 0.1 mm. It is the thickness of the connector 38 and/or of any passive and/or active components that defines the overall size of the antenna in the thickness direction.

It should be added that the shape of the first conductive surface 10 may be different providing it does indeed define an open inside space 18, since this conductive surface needs to be matched to the radiating element 24.

Figure 2A:
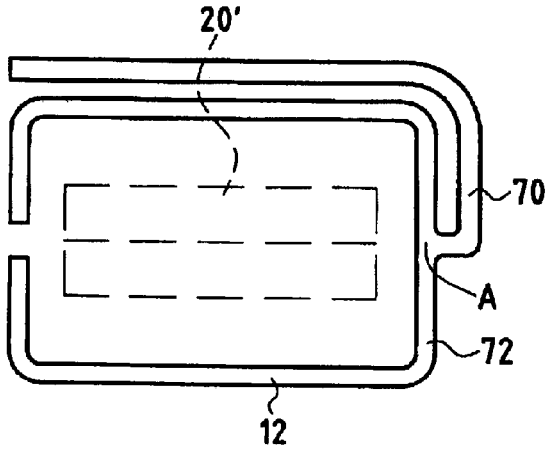
FIGS. 2A, 2B, and 2C show first variant embodiments of the first conductive surface.
Figure 2B:
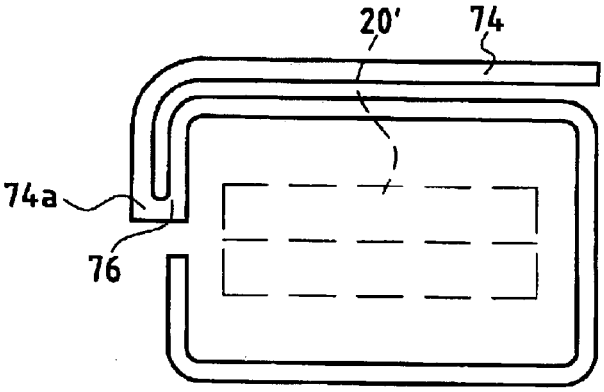
Figure 2C:
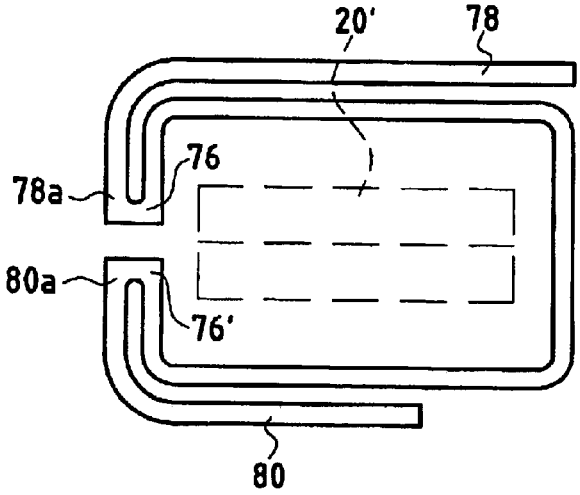
Figure 2D:
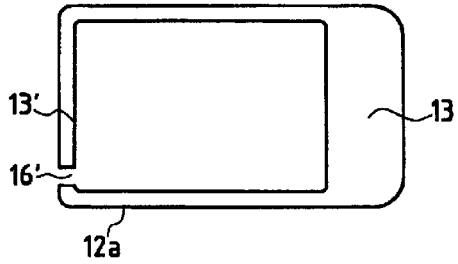
FIGS. 2D and 2E show second variant embodiments of the first conductive surface.
Figure 2E:
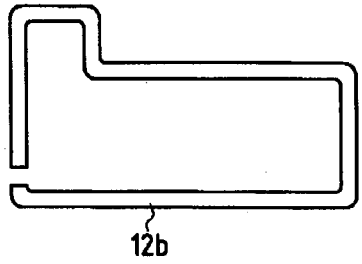

FIGS. 2D and 2E show two other possible shapes for the first conductive surface 12.

In FIG. 2D, the first conductive surface 12*a* has one short side 13 of width that is greater than the other sides. In addition, the opening 16' made in the second short side 13' is not in a middle portion.

In FIG. 2E, the first conductive surface 12*b* is in the form of an irregular six-sided polygon. This shape can enable the size of the antenna to be conformed to the surroundings while still itself surrounding the second conductive surface that constitutes the radiating assembly.

It will be understood that it would not go beyond the invention if the conductive surfaces 10 and 20 were obtained by being cut out from a sheet of metal instead of being constituted by areas of metallization implemented on an insulating substrate 30 and subsequently etched by any suitable method in order to define the particular shapes of the two surfaces. The sheet metal could be of thickness lying in the range about 0.2 mm to 0.3 mm. In which case, it would naturally be necessary to provide a mechanical support of insulating material in order to hold the two conductive surfaces relative to each other.

FIGS. 2A, 2B, and 2C show variant embodiments of the first conductive surface. The second conductive surface may be of a shape such as to define two or even more radiating elements, of dimensions that correspond to two or more distinct frequency bands.

Under such circumstances, the first conductive surface in the form of a conductive strip defining an open rectangle cannot be tuned with both radiating elements.

It has been found that by adding at least one conductive extension to the conductive strip 12 shown in FIGS. 1A and 2, the extension constitutes a filter or trap, thereby providing an improvement in semi-independence for the frequency bands used.

In FIG. 2A, the open conductive strip 12 is shown with the two radiating elements 20' being represented symbolically. The first conductive surface also comprises a conductive extension 70 connected to the midpoint A of the closed short side 72 of the strip 12. For reasons of compactness, the extension 70 is disposed along one of the long sides of the strip 12.

In the embodiment of FIG. 2B, the conductive extension 74 has an end 74*a* which is connected to an open end 76 of the strip 12.

In the embodiment shown in FIG. 2C, the first conductive surface comprises not only the strips 12, but also two conductive extensions 78 and 80, the first ends 78*a* and 80*a* of these extensions being connected to respective open ends 76 and 76' of the strip 12.

Figure 3:
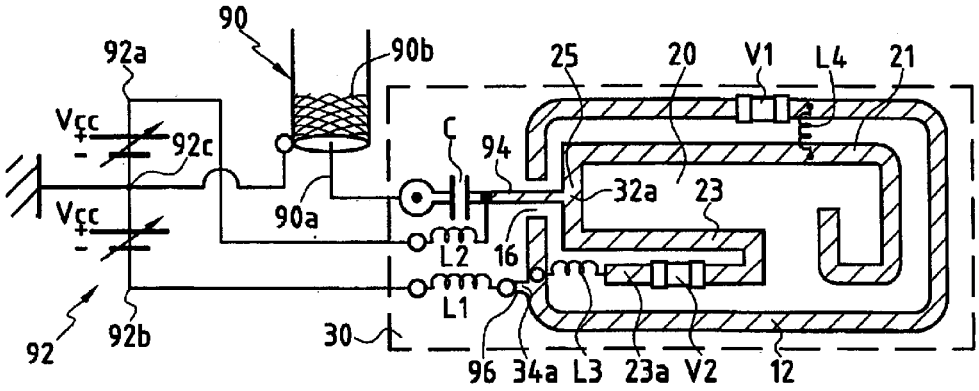
FIG. 3 shows a variant embodiment of the antenna in which it includes active components.

FIG. 3 shows an embodiment of the antenna together with its active components.

In FIG. 3, there can be seen the first metallization constituted by the conductive strip 12 and its opening 16, together with its ground contact zone 34*a*.

There can also be seen the second conductive surface 20 which, in this embodiment, is constituted by two radiating elements 21 and 23 connected to the connection zone 25, itself including the contact zone 32*a* of the antenna. The figure also shows the antenna cable 90 with its central conductor 90*a* and its shielding 90*b*.

In this embodiment, the conductive strip 12 and the radiating element 23 are provided with respective active components constituted by varactors V1 and V2 connected in series with the corresponding metallization, the electrical energy fed to the varactors being delivered by the shielding 90*b* of the antenna cable which powers a variable direct current (DC) power supply 92. The midpoint 92*c* of the power supply 92 is connected to the shielding of the cable, and the output terminals 92*a* and 92*b* of the power supply serves to power the varactors V1 and V2. The contact zone 32*a* is connected to the central conductor 90*a* of the cable by metallization 94 connected to the contact zone 32*a,* passing through the opening 16, and via a blocking capacitor C.

The output terminal 92*a* of the power supply 92 is connected to the metallization 94 via a choke L1. The output terminal 92*b* of the power supply 92 is connected to the ground contact zone 34*a* via a choke L2 and a conductive extension 96. The end 23*a* of the metallization 23 is connected to the ground contact zone 34*a* via a choke L3 for powering the varactor V2, and the metallization 21 is connected to the conductive strip L4 in order to power the varactor V1.

By varying the DC voltage delivered by the power supply 92, the capacitance across the terminals of the varactors V1 and V2 is varied.

These active or passive components may be varactors, junction field effect transistors (JFETs), microelectrical mechanical systems (MEMS), inductors, capacitors, or combinations thereof, serving to increase the electrical length of the radiating element, or optionally also of the second conductive surface in order to match the antenna to another frequency band without changing the shape of the antenna.

Figure 3A:
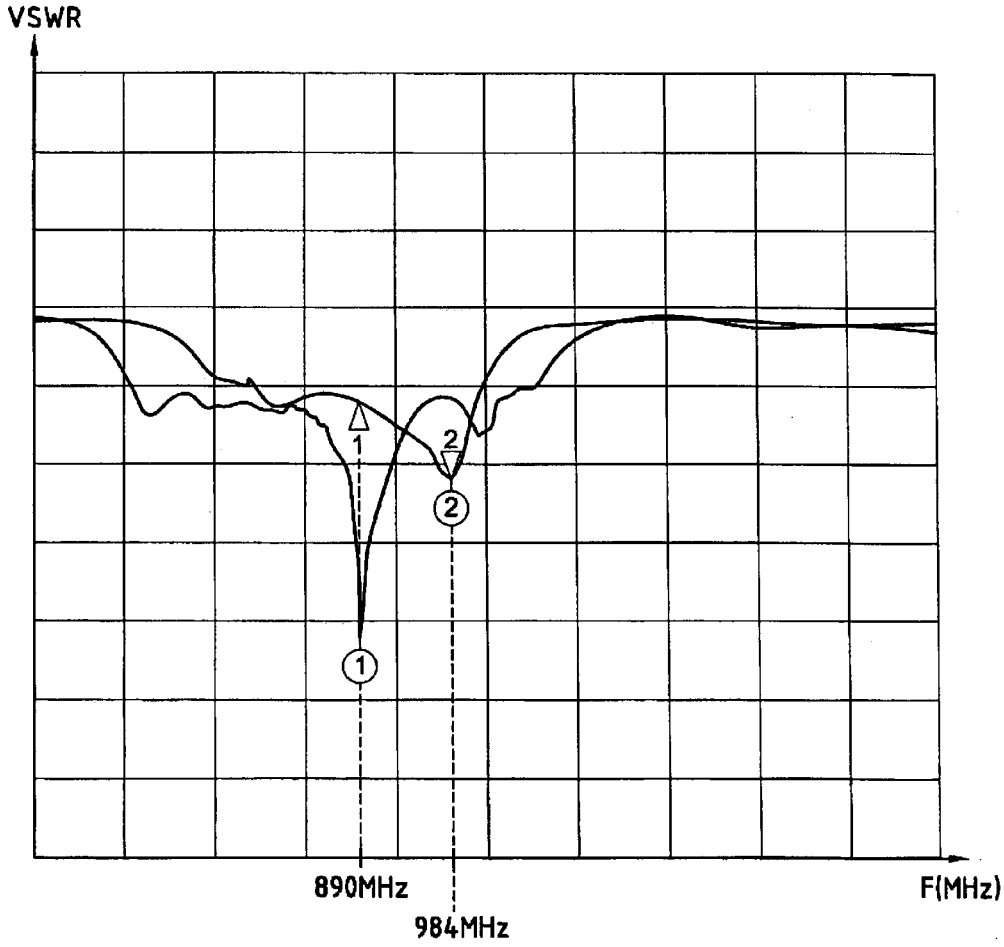
FIG. 3A is a graph plotting voltage standing wave ratio (VSWR) as a function of frequency when resonance is transformed from 890 MHz to 984 MHz.

FIG. 3A shows how resonance at 890 MHz can be transformed into resonance at 984 MHz, i.e. shifted through about 100 MHz, by switching a passive element.

Figure 4:
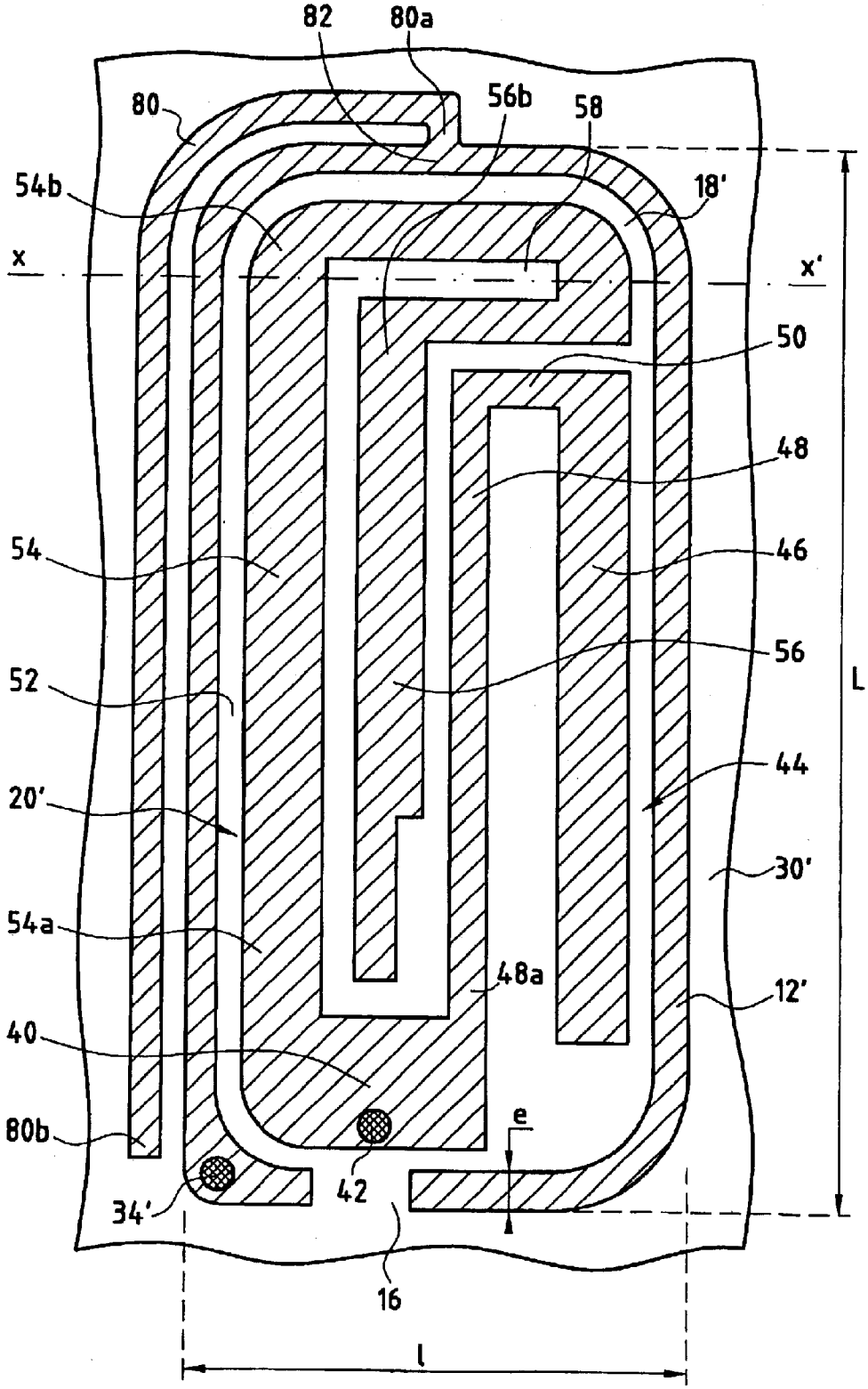
FIG. 4 is a plan view of a preferred embodiment.

With reference now to FIG. 4, there follows a description of an improved embodiment of the antenna, this antenna being capable of operating in two frequency ranges corresponding in this particular case to four bands: GMS 850; GSM 900; DCS 1800; and PCS 1900.

In this embodiment, the first conductive surface is constituted by a conductive strip 12' whose midline 14' is a rectangle with the exception of the opening 16', the width e of the strip being substantially constant and equal to 1 mm in this embodiment. The ground contacts 34' and the antenna feed contact 42 are implemented by additional surface metallization, e.g. of gold so that it is possible to use contact springs, for example.

The second conductive surface 20' which is disposed entirely inside the inside space 18' defined by the conductive strip 12' constitutes a radiating assembly for the antenna, said radiating assembly defining in this particular case two radiating elements tuned on two distinct frequency ranges. More precisely, the conductive surface 20' has a connection zone 40 provided with an antenna contact 42. The conductive surface 20' has a first portion 44 constituting a first radiating element for the higher DCS or PCS frequency bands. The radiating element 44 is generally U-shaped comprising two branches 46 and 48 interconnected at one of their ends by the conductive portion 50. The end 48*a* of the branch 48 is connected to the connection zone 40. The second radiating element 52, corresponding to the lower frequency ranges, is tuned to the GSM 850 or GSM 900 frequency bands. This portion 52 comprises a first rectilinear branch 54 whose end 54*a* is connected to the connection zone 40, and a second branch 56, the ends 54*b* and 56*b* being interconnected by a conductive surface portion 58 that is U-shaped having an axis x,x' which is orthogonal to the direction in which the branches 54 and 56 extend.

The conductive strip 12' is defined in such a manner as to be tuned with the radiating elements 44.

Preferably, in order to ensure that the first conductive surface is tuned to both frequency ranges corresponding to the two radiating elements, the conductive strip 12' is associated with an extension 80 constituted by an additional metal strip having one end 80*a* electrically connected to the center 82 of the closed short side of the strip 12'. The other end 80*b* of the metallization 80 is free.

In the embodiment shown in FIG. 4, the opening 16' provided in the strip 12' is of a length equal to 2 mm. More generally, this opening must be very short compared with the length of the conductive strip 12'. Preferably, the length of the opening is less than 3 mm.

Figure 5:
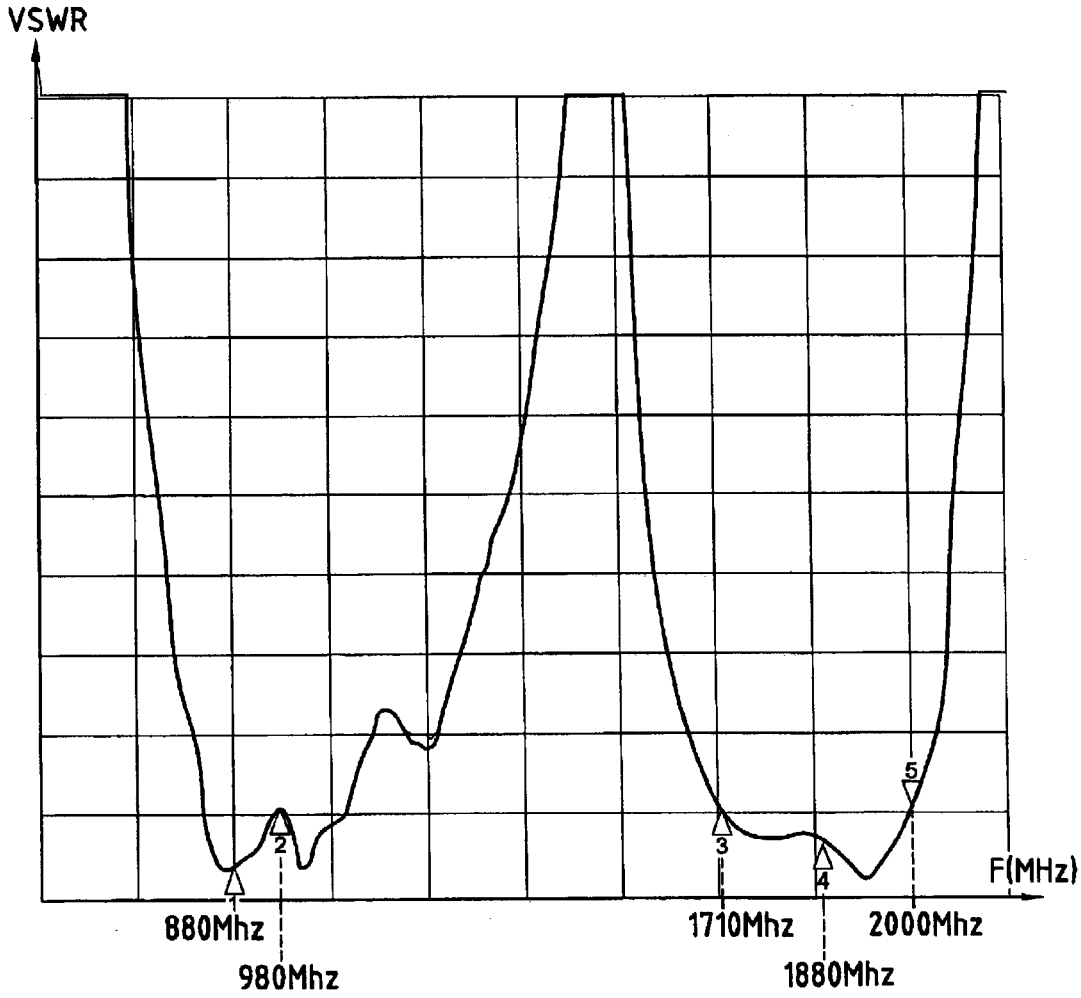
FIG. 5 is a graph plotting VSWR as a function of frequency in two ranges around 850 MHz and around 1900 MHz for the antenna of FIG. 4.

FIG. 5 shows the operation of the antenna shown in FIG. 4. It plots VSWR as a function of frequency F, and shows the size of the passband in the GSM 850, 900 MHz range and in the DCS, PCS range.

It is important to observe that all of the metallization constituting the first conductive surface 12' and constituting the second conductive surface 20' is very compact and occupies the major portion of the rectangle of length L and width l. The thickness of the antenna is equal to the thickness of the insulating substrate 30' on which it is made, ignoring the thickness of the connector which is associated therewith.

What is claimed is:

1. A very small volume and broad band antenna for a portable appliance including a transceiver module with an independent ground and an antenna feed conductor, the antenna comprising:

a first conductive surface lying substantially in a first geometrical surface of non-closed curvilinear shape surrounding an inside space and connectable at a single electrical connecting point to said independent ground of the transceiver module of said appliance, wherein the curvilinear shape defines a loon with first and second spaced apart ends forming an opening therebetween; and a second conductive surface disposed substantially in a second geometrical surface substantially coinciding with said first geometrical surface and situated in said inside space, and forming a radiating assembly connectable to said antenna feed conductor;

whereby said antenna is semi-independent of the elements of said appliance.

2. An antenna according to claim 1, wherein said first surface is substantially in the form of a non-closed conductive strip whose mean line is polygonal in shape, defining an opening between said first and second spaced apart ends.

3. An antenna according to claim 1, wherein said opening is less than or equal to 3 mm wide.

4. An antenna according to claim 2, wherein said second surface defines at least two radiating elements of lengths adapted to resonate in the working frequency ranges of the antenna.

5. An antenna according to claim 1, wherein said second surface defines a connection zone and a plurality of radiating elements corresponding to working frequency ranges.

6. An antenna according to claim 4, wherein the strip forming said first surface is tuned to one of the radiating elements.

7. An antenna according to claim 6, wherein said first surface further comprises at least one conductive extension in addition to said strip, the extension being electrically connected to said strip.

8. An antenna according to claim 1, further comprising at least one active or passive component electrically connected to at least one of said conductive surfaces.

9. An antenna according to claim 8, wherein said component is active and the DC power supply for said active component is delivered via the radiofrequency coaxial feed to the antenna.

10. An antenna according to claim 1, further comprising a coaxial connector connected to each of said conductive surfaces.

11. An antenna according to claim 1, further comprising a two-channel connector, each channel being respectively connected to one of said two conductive surfaces.

12. An antenna according to claim 1, further comprising a rigid or flexible insulating support having said first and second conductive surfaces made on one of its faces.

13. An antenna according to claim 1, wherein said conductive surfaces are made of machined conductive sheet metal.

14. An antenna according to claim 1, wherein said geometrical surfaces are curved.

15. An antenna according to claim 1, wherein said geometrical surfaces are plane.

16. A very small volume and broad band antenna for a portable appliance including a transceiver module with an independent ground and an antenna feed conductor, the antenna comprising:

a first conductive surface having first and second spaced apart ends lying substantially in a first geometrical surface and electrically connected at a single point to said independent ground, wherein said first conductive surface is substantially in the form of a non-closed conductive strip having a mean line in the shape of a polygon forming an interior space and having an opening between said first and second ends; and second conductive surface disposed substantially in a second geometrical surface substantially coinciding with said first geometrical surface and situated substantially within said interior space, and forming a radiating assembly adapted to be connected to said antenna feed conductor.

17. An antenna according to claim 16, further comprising at least one active or passive component electrically connected to at least one of said first or second conductive surfaces.

18. An antenna according to claim 16, further comprising a two-channel connector, each channel being respectively connected to at least one of said first and second conductive surfaces.

19. An antenna according to claim 16, further comprising a rigid or flexible insulating support having at least one surface, wherein said first and second conductive surfaces are attached to said insulating support surface.

* * * * *